US006142355A

United States Patent [19]

Wu

[11] Patent Number: 6,142,355

[45] Date of Patent: Nov. 7, 2000

[54] STRUCTURE OF A STAPLER

[76] Inventor: Man-Tang Wu, P.O. Box 82-144, Taipei, Taiwan

[21] Appl. No.: 09/209,692

[22] Filed: Dec. 11, 1998

[51] Int. Cl.[7] ..... B25C 5/02; B25C 5/06

[52] U.S. Cl. ..... 227/134; 227/120

[58] Field of Search ..... 227/134, 125, 227/126, 120, 156, 127, 109

[56] References Cited

U.S. PATENT DOCUMENTS

| | | | |
|---|---|---|---|
| 2,227,826 | 1/1941 | Drypolcher et al. | 227/125 |
| 2,311,412 | 2/1943 | Pankonin | 227/126 |
| 2,522,931 | 9/1950 | Curtiss | 227/126 |
| 2,781,515 | 2/1957 | Juilfs | 227/127 |
| 3,945,550 | 3/1976 | Monacelli | 227/126 |
| 4,405,073 | 9/1983 | Salleras Escalante | 227/120 |
| 4,496,091 | 1/1985 | Yasuda | 227/120 |
| 4,607,777 | 8/1986 | Ebihara | 227/120 |
| 4,717,062 | 1/1988 | Ebihara | 227/156 |
| 4,732,309 | 3/1988 | Judge | 227/125 |
| 4,878,608 | 11/1989 | Mitsuhashi | 227/120 |
| 5,009,356 | 4/1991 | Chang | 227/120 |
| 5,038,992 | 8/1991 | Shiang et al. | 227/120 |
| 5,931,365 | 8/1999 | Huang | 227/120 |

*Primary Examiner*—Peter Vo
*Assistant Examiner*—James Calve
*Attorney, Agent, or Firm*—A & J

[57] ABSTRACT

An improved structure of a stapler is disclosed and the stapler allows loading multiple units of staples therein. The stapler comprises a top shell, a slotting seat, a sliding seat, and a bottom seat. A cartridge is slidably inserted at one end of the slotting seat and moveable along the slotting seat. More than one unit of staples can be loaded into the stapler by placing the staples into the cartridge and then push the cartridge into the slotting seat.

1 Claim, 5 Drawing Sheets

STRUCTURE OF A STAPLER

BACKGROUND OF THE INVENTION

1. Field of the Invention

The present invention relates to an improved structure of a stapler, in particular, to a stapler having a slidable cartridge which allows loading of multiple units of staples into the stapler.

2. Description of the Prior Art

A conventional stapler essentially consists of an upper shell, an intermediate slotting seat, a sliding seat and a bottom seat. Normally, only a single unit of staples is loaded onto the slotting seat. An urging plate is vertically and downwardly mounted at the front end of the upper shell. A pair of guiding ends are formed at the front end of the slotting seat so as to block the staples when they are urged to the front end by the sliding seat. The urging plate presses a staple from the top thereof into an object to be stapled. When the staples in the slotting seat have been used up and a new unit is to be loaded, the upper shell of the stapler has to be lifted up and the sliding seat has to be pushed backward to the rear end of the slotting seat. After that the new unit of staples is then loaded. Owing to the fact that the front end of the sliding seat is attached to a spring at one end and, and the other end of the spring is secured to a hook provided at the front end of the slotting seat, close to the guiding end, the sliding seat tends to oppose the direction of back ward push and move forward to the guiding end. Thus, when the user lifts up the upper shell and moves the sliding seat with one hand, and the other hand is used to fill a replacement unit of staples, occasionally the insufficient force of the fingers may cause the sliding seat to return to its original position, i.e. to move towards to the guiding end with a great speed. Thus, the fingers of the user may be hurt accidentally. Besides, for this conventional stapler, only one unit of staples can be filled to the slotting seat at a time and it is inconvenient to the user if there are multiples objects need to be stapled.

SUMMARY OF THE INVENTION

The present invention has been designed to solve the above-mentioned drawbacks inherent in conventional staplers. The present invention allows loading multiple units of staples to the stapler by sliding out the cartridge which is slidably mounted onto the slotting seat, and then re-fill with new unit of staples.

Accordingly, it is another object of the present invention to provide an improved structure of a stapler which has a simpler structure and is easily to manufacture. It is another object of the present invention to provide an improved structure of a stapler which facilitates loading of multiple units of staples into the cartridge.

Another object of the present invention is to provide an improved structure of a stapler, wherein the sliding seat will not accidentally hurt the fingers of the user.

It is yet another object of the present invention to provide an improved structure of a stapler, which eliminates and mitigates problems associated with conventional staplers.

DETAILED DESCRIPTION OF THE PRESENT INVENTION

Figure 1:
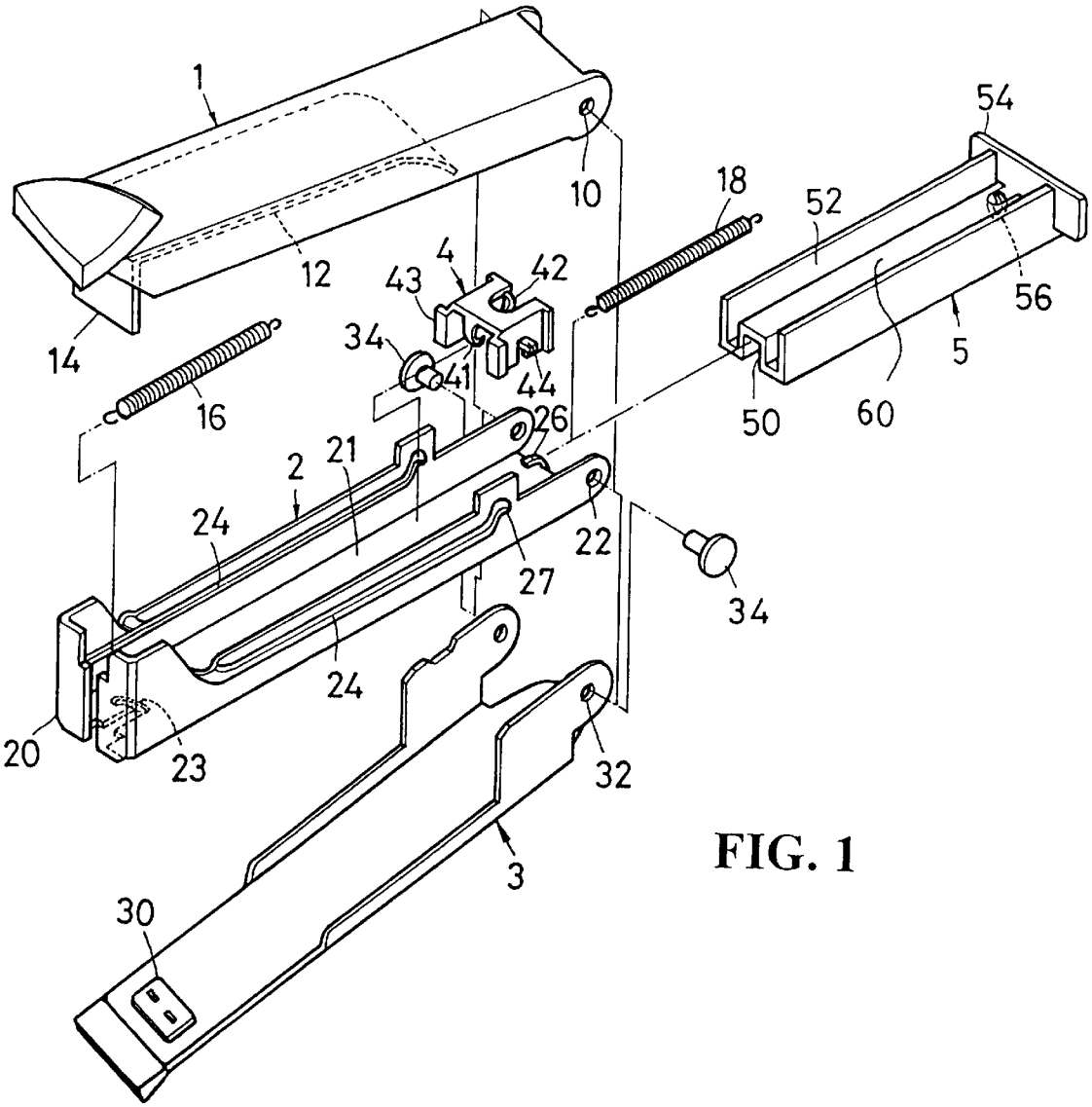
FIG. 1 is a perspective exploded view of a stapler in accordance with the present invention.

The following is a description of a stapler according to the present invention, reference being made to the drawings in which like reference numerals identify like elements of structure in each of the several figures.

FIG. 1 is an exploded view of the stapler and it partially represents a conventional stapler. Therefore, the figure is used partially when a conventional type of stapler is described. A conventional stapler comprises a top shell (1) having a downwardly curved flexible plate at the bottom surface thereof, an intermediate slotting seat (2) having a slot (21), a bottom seat (3), and a sliding seat (4). The bottom face of the front end of the top shell (1) is an urging plate (14) which faces downward The front end of the slotting seat (2) (corresponding to the urging plate (14)) is a pair of a guiding ends (20) formed integrally with the seat (2), and with a first hook (23) adjacent to the guiding ends (20) and within the front end of the slot (21). The first hook (23) is engaged with a first spring (16) at one end, and the other end of the spring (16) is mounted to a third hook (41) of the sliding seat (4) such that the sliding seat (4) is slidably moved within the slot (21). The respective rear ends of the top shell (1), the slotting seat (2) and the bottom seat (3) are respectively provided with a first, a second and a third aperture (10) (22) (32) and are pivotally fastened by a rivet (34). As some of the space in the slot (21) of the slotting seat (2) is taken up by the sliding seat (4), only a single unit of the staples can be loaded onto the slot (21). At this instance, when a new unit of staples is to be loaded, the top shell (1) is lifted up with one hand and the sliding seat (4) is moved backward to the rear end of the slot (21). The other hand is used to load the staples (6). This process of loading the staples for a conventional stapler is troublesome and labourious, and may accidentally injure the fingers of the user if the sliding seat (4) is sprung back to its original position.

In accordance with the present invention, and referring to FIG. 1, the present invention comprises (a) a top shell (1) having a front and a rear end being downwardly mounted at the front end with a perpendicular urging plate (14), (b) a slotting seat (2) having an open slot (21), corresponding to the bottom of the top shell (1); c a bottom seat (3) and a sliding seat (4). The open slot (21) is used to accommodate the staple and the sliding seat (4) and allows the sliding seat (4) to urge the staple at one end thereof. At the respective rear ends of the top shell (1), the slotting seat (2) and the bottom seat (3), a first (10), second (22) and third (32) apertures are individually provided, such that the top shell (1), the slotting seat (2) and the bottom seat (3) are pivotally fastened together by a rivet (34), and thus the top shell (1), the slotting seat (2) and the bottom seat (3) are rotatable about the rivet (34).

Referring again to FIG. 1, the slotting seat (2) is longitudinally and vertically mounted with a pair of lateral wall, each wall being provided with a first lateral groove (24) for the slidably engagement with the sliding seat (4) such that the seat (4) is moveable within the slotting seat (2). The rear end of the groove (24) is curved upward. As shown in the Figure, a pair of protrusions (44) are provided at the lateral side of the sliding seat (4). These protrusions (44) are slotted into the first lateral grooves (24) so that the sliding seat (4) is slidable within the slot (21) of the slotting seat (4) and guided by the grooves (24). A third hook (41) is provided at the front end of the sliding seat (4) for the engagement with one end of the first spring (16). The rear end of the sliding seat (4) is provided with a forth hook (42). The other end of the first spring (16) is fitted to the first hook (23) (being mounted closely to the guiding end (20)) of the slot (21), such that the sliding seat (4) is pulled by the first spring (16) when the sliding seat (4) is pushed backward. As the first spring (16) opposes the direction of the movement of the sliding seat (4), the staples (6) are urged towards the guiding end (20).

A second hook (26) is mounted at the open rear end of the slotting seat (2). A cartridge (5) having an open front end is insertable from the rear open area of the slotting seat (2) and enters the slot (21). The rear end of the cartridge (5) is closed with an engaging board (54), and a re-filing slot (52) is formed within the cartridge (5).

Figure 2:
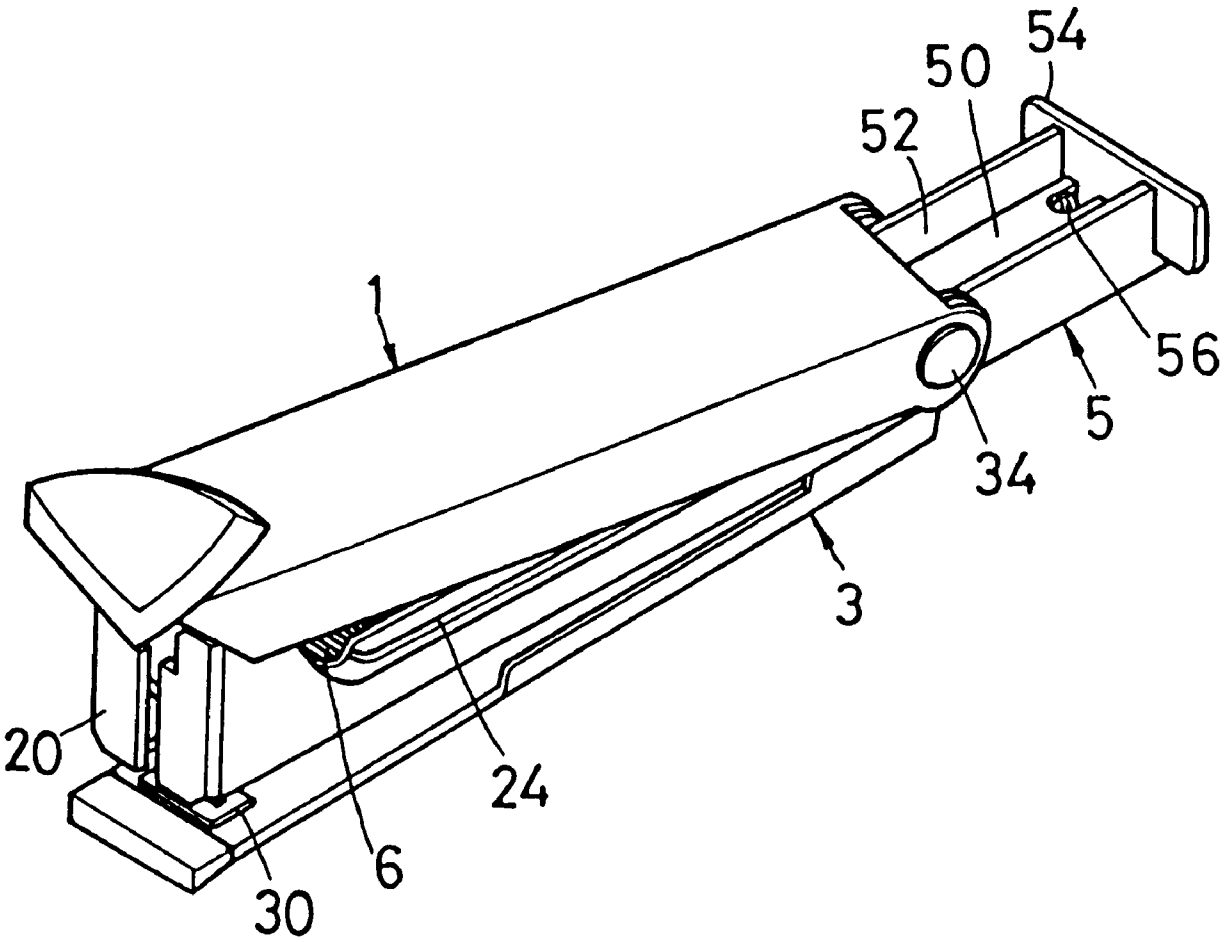
FIG. 2 is a perspective view of a stapler showing the slidable cartridge being pulled out from the slotting seat, in accordance with the present invention.
Figure 3:
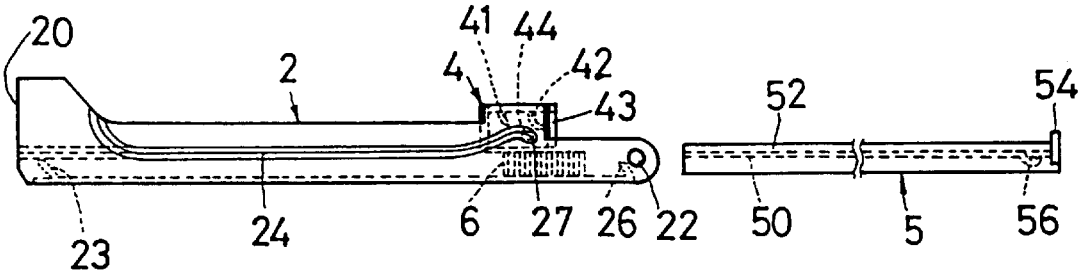
FIG. 3 is an elevational schematic view showing the position of the cartridge after an unit of the staples being loaded within the slotting seat, in accordance with the present invention.
Figure 4:
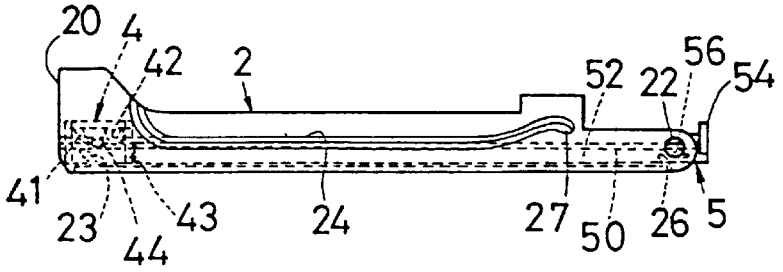
FIG. 4 is another elevational schematic view showing the position of the staples in accordance with the present invention.

A protruded ridge (60) is axially provided within the re-filing slot (52). The ridge (60) has a hollow channel (50) at the bottom thereof. A fifth hook (56) is provided adjacent to the engaging board (54), but at the rear end of the bottom channel of the ridge (60). A second spring (18) is fitted at one end to the fifth hook (56) of the cartridge (5) at one end. The other end of the second spring (18) is fitted to the second hook (26) and the spring (18) is enclosed under the hollow channel (50) of the ridge (60). The forth hook (42) is another alternative engagement for the second spring (18). Referring to FIGS. 2 to 4, in operation or to insert multiple units of staples, the cartridge (5) is pulled out at the engaging board (54) from the slotting slot (2) and then load the staples from the top of the cartridge (5) onto the re-filing slot (52), or pull up the top shell (1) at the front end (while the rear end is pivotally hinged) and move the sliding seat (4) within the slotting seat (2) backward (towards the rear end of the seat (2). The sliding seat (4) is temporarily engaged at an engaging end (27) at the rear end of the first lateral groove (24). A new unit of staples is then placed onto the slot (21) of the slotting seat (2). By triggering the sliding seat (4)), the seat (4) will urge the staples (6) towards the guiding ends (20).

Referring again to FIGS. 1 to 4, if a new unit of staples is to be loaded to the stapler, where the forth hook (42) at the rear end of the sliding seat (4) is fitted to one end of the second spring (18), then the top shell (1) does not need to be lifted. To achieve the replacement of the staples (6), the cartridge (5) is pulled backward. As the forth hook (42) is fitted to the fifth hook (56) of the cartridge (5), the backward movement of the cartridge (5) will cause the sliding seat (4) to stop at the engaging end (27). As the rear end of the lateral groove (24) is curved upward, a gap of sufficient height is formed at the bottom of the sliding seat (4), which allows multiple units of staples (6) to move forward. By pushing the cartridge (5) to enter the slotting seat (2), the multiple units of staples (6) are urged by the sliding seat (4). The front edge of the sliding seat (4) is provided with a pair of lateral board (43) so that the staples are fully pushed forward.

Figure 5:
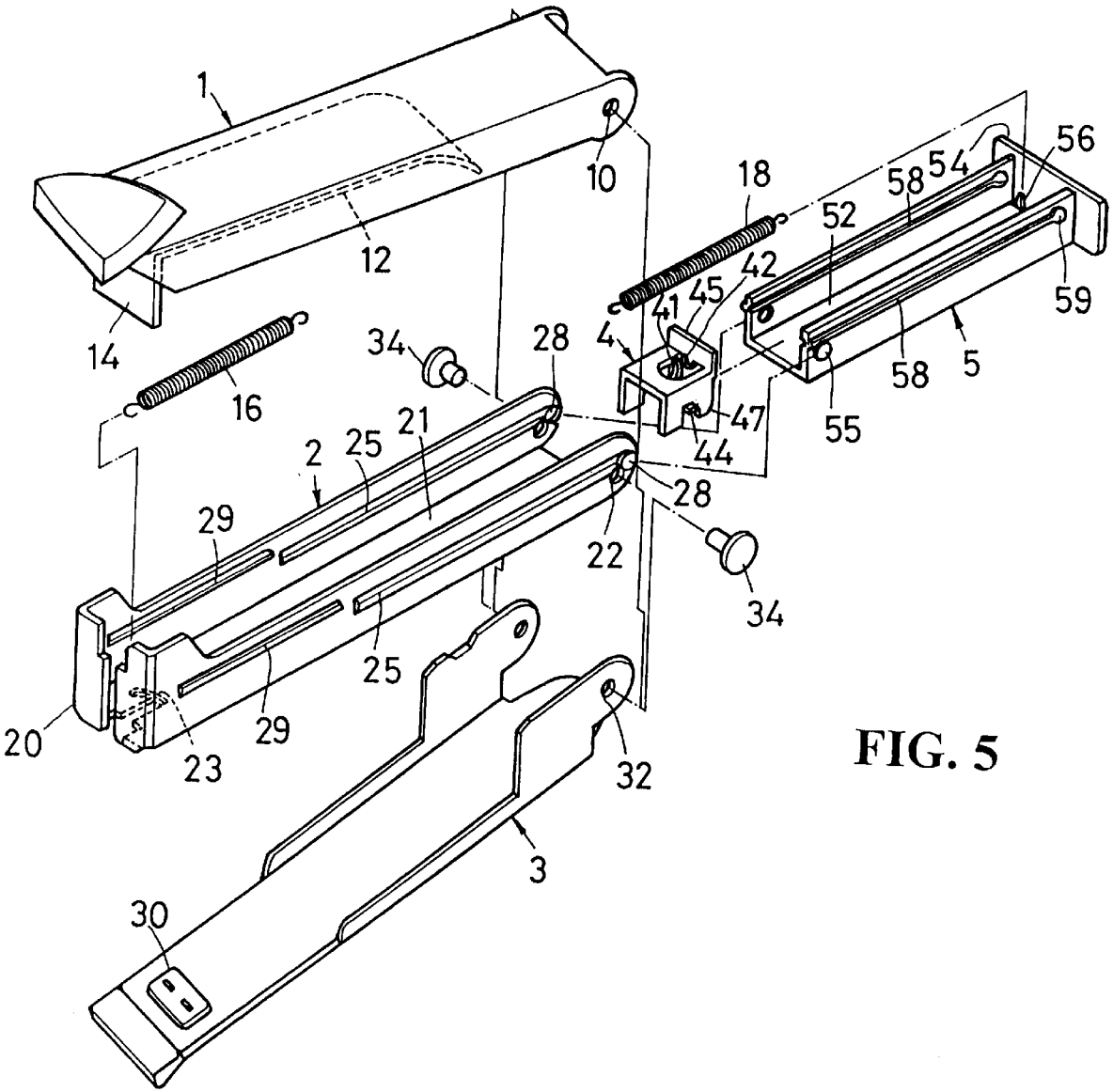
FIG. 5 is an exploded perspective view of another preferred embodiment in accordance with the present invention.
Figure 6:
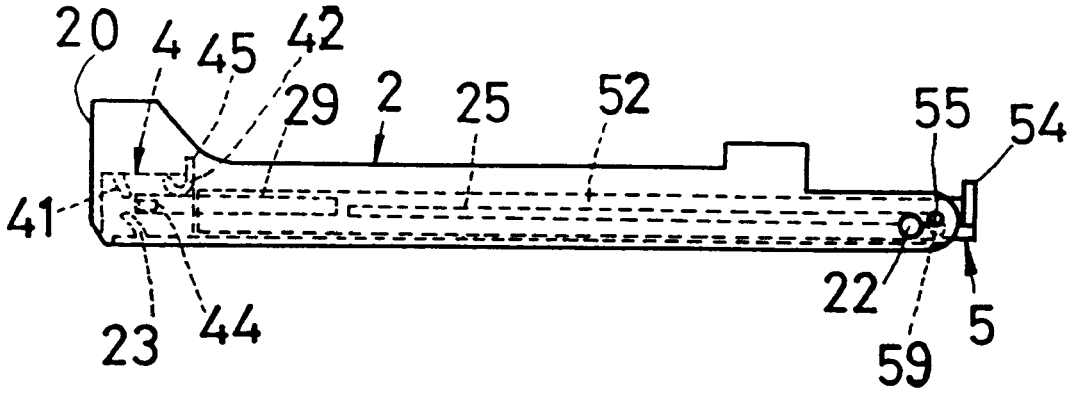
FIG. 6 is an elevational schematic view of the preferred embodiment of FIG. 5 in accordance with the present invention.

FIGS. 5 and 6 show another preferred embodiment of an improved structure of a staple in accordance with the present invention. The staple is provided with a forth lateral groove (58) along the lateral wall of the cartridge (5). In this embodiment, a ridge (60) is not required within the re-filing slot (52). A triggering plate (45) is formed at the rear end of the sliding seat (4). A third lateral groove (29) is formed along the front section of the lateral wall enclosing the slot (21). A second lateral groove (25) is formed at the rear section of the lateral wall of the slotting seat (2), and the second grooves (25) has a lower height than the third lateral groove (29). The sliding seat (4) is inserted into the re-filing slot (52) and the cartridge (5) is insertable to the slotting seat (2).

In operation, the cartridge (5) is moved backward and the sliding seat (4) is moved to the engaging board (54) of the cartridge (5). A multiple units of staples (6) are loaded onto the re-filing slot (52) and then release the sliding seat (4). Then, insert the cartridge (5) into the slotting seat (2) and the stapler is now loaded with staples (6).

In order to facilitate the loading of staples, the rear end of the forth lateral groove (58) of the cartridge (5) is provided with a second engaging end (59). Thus, the backward movement of the sliding seat (4) can be stopped at the place near to the engaging board (54). In addition, the front end of the lateral wall of the cartridge (5) is provided with protrusions (55) to fit into a corresponding recess (28) mounted at the slotting seat (2). Thus, when the cartridge (5) is pulled out from the slotting seat (4) it can be temporarily engaged in position so as to facilitate the loading of the staples.

Referring to FIG. 4, the rear bottom end of the sliding seat (4) formed a smooth cutting edge (47) so that the sliding seat (4) can be easily and smoothly moved back to the cartridge (5) when the triggering plate (45) is slightly pushed.

It is to be understood that the invention is not limited to the disclosed embodiments, but is intended to cover various modifications and equivalent arrangements included within the spirit and scope of the appended claims.

I claim:

1. A stapler comprising:

a top shell having front and rear ends, said front end being provided with a downwardly extending urging plate;

a slotting seat having an open slot corresponding to a bottom of said top shell;

a bottom seat mounted under said slotting seat and pivotally connected to the slotting seat and the top shell;

a sliding seat having a pair of lateral protrusions, one protrusion being mounted on each lateral side thereof, said sliding seat being slidably disposed within the slotting seat, a front edge of said sliding seat being provided with a pair of lateral boards to urge a unit of staples toward a front end of the slotting seat;

a cartridge having a central raised ridge along a longitudinal axis thereof and a hollow channel formed beneath a bottom surface of the central ridge, said cartridge being slidably mounted within the slotting seat with the sliding seat disposed in front of the cartridge;

first and second lateral grooves, said first lateral groove being provided in one lateral wall of the slotting seat and said second lateral groove being provided in the other lateral wall of the slotting seat, wherein one of the lateral protrusions of the sliding seat is movably disposed within the first lateral groove and the other lateral protrusion is movably disposed within the second lateral groove, each of said lateral grooves having an upwardly curved stop end, wherein when the sliding seat is moved to the rear of the slotting seat and the lateral protrusions are disposed in the stop ends, a gap is formed between the sliding seat and the slotting seat open slot;

a first spring, one end of which is fitted to a first hook provided at the front end of the slotting seat, and the other end of which is connected to the front end of the sliding seat to urge the sliding seat and staples toward the front end of the slotting seat; and a second spring, one end of which is connected to a rear end of the cartridge, and the other end of which is secured to a hook at a rear end of the sliding seat, wherein when the cartridge is moved backward to stop the sliding seat at said stop ends, multiple units of staples can be loaded onto the cartridge and through said gap, said staple units being further loaded into the slotting seat when the cartridge is moved forward to release the sliding seat from the stop ends.

* * * * *